US007654635B2

(12) United States Patent
Askeland et al.

(10) Patent No.: US 7,654,635 B2
(45) Date of Patent: Feb. 2, 2010

(54) MEDIA PRINT SYSTEM

(75) Inventors: Ronald A. Askeland, San Diego, CA (US); William S. Osborne, Camas, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 759 days.

(21) Appl. No.: 10/988,902

(22) Filed: Nov. 15, 2004

(65) Prior Publication Data

US 2006/0103707 A1 May 18, 2006

(51) Int. Cl.
*B41J 23/00* (2006.01)
*B41J 2/01* (2006.01)

(52) U.S. Cl. ..... 347/37; 347/101

(58) Field of Classification Search ..... 347/22–36, 347/104, 105, 37, 42, 49, 29, 101
See application file for complete search history.

(56) References Cited

U.S. PATENT DOCUMENTS

| | | | | |
|---|---|---|---|---|
| 4,259,696 | A | | 3/1981 | Paranjpe et al. |
| 4,325,086 | A | | 4/1982 | Sato et al. |
| 4,340,893 | A | | 7/1982 | Ort |
| 4,467,366 | A | | 8/1984 | Bobick et al. |
| 4,469,026 | A | | 9/1984 | Irwin |
| 4,520,368 | A | | 5/1985 | Ims |
| 4,566,014 | A | | 1/1986 | Paranjpe et al. |
| 4,774,523 | A | | 9/1988 | Beaufort et al. |
| 4,811,038 | A | | 3/1989 | Gordon et al. |
| 4,914,478 | A | | 4/1990 | Yashiki |
| 4,970,528 | A | | 11/1990 | Beaufort et al. |
| 4,982,207 | A | | 1/1991 | Tunmore et al. |
| 5,040,074 | A | | 8/1991 | Stemmle |
| 5,214,442 | A | | 5/1993 | Roller |
| 5,227,815 | A | | 7/1993 | Dastin et al. |
| 5,296,873 | A | | 3/1994 | Russell et al. |
| 5,356,229 | A | | 10/1994 | Hickman et al. |
| 5,517,222 | A | | 5/1996 | Sugiyama et al. |
| 5,717,451 | A | * | 2/1998 | Katano et al. ..... 347/242 |
| 5,771,054 | A | | 6/1998 | Dudek et al. |
| 5,838,343 | A | * | 11/1998 | Chapin et al. ..... 347/22 |
| 5,847,719 | A | * | 12/1998 | Yamaguchi et al. ..... 346/134 |
| 6,164,747 | A | * | 12/2000 | Yashima et al. ..... 347/15 |
| 6,183,063 | B1 | * | 2/2001 | Bolash et al. ..... 347/42 |
| 6,250,738 | B1 | | 6/2001 | Waller et al. |
| 6,318,840 | B1 | * | 11/2001 | Sette et al. ..... 347/37 |
| 6,357,855 | B1 | | 3/2002 | Kerekes et al. |
| 6,481,822 | B2 | | 11/2002 | Murcia et al. |
| 6,604,810 | B1 | * | 8/2003 | Silverbrook ..... 347/32 |
| 2002/0080210 | A1 | * | 6/2002 | Verhoest et al. ..... 347/40 |
| 2004/0046851 | A1 | * | 3/2004 | Yang et al. ..... 347/104 |
| 2005/0237358 | A1 | * | 10/2005 | Jones et al. ..... 347/37 |

* cited by examiner

*Primary Examiner*—Stephen D Meier
*Assistant Examiner*—Geoffrey Mruk

(57) ABSTRACT

A media print system includes a first print unit, a second print unit, at least one actuator configured to move the first unit and the second unit relative to one another and a controller configured to generate control signals. The at least one actuator positions the first unit and the second unit at the first and second positions, respectively, during a first longitudinal pass of a medium and positions the first unit at a third position during a second longitudinal pass of the medium in response to the control signals.

33 Claims, 9 Drawing Sheets

MEDIA PRINT SYSTEM

CROSS-REFERENCE TO RELATED PATENT APPLICATIONS

Media print system 10 generally includes media transport 14, print unit 16, print unit 18, actuator 20, actuator 22, service station 24, service station 26 and controller 28. Media transport 14 comprises a device configured to move media 12 relative to print units 16 and 18. In one embodiment, media transport 14 is configured to longitudinally move a first medium having a first transverse dimension and a second medium having a second greater transverse dimension. In particular, media transport 14 is configured to move media 12 in a longitudinal direction as indicated by arrow 32. Media transport 14 is further configured, according to some embodiments, to move media 12 through one or more passes relative to print units 16, 18. In one embodiment, media transport 14 may comprise a drum, a belt or a series of rollers configured to engage and rotate or wrap media 12 about one or more axes so as to move media 12 through one or more passes relative to print units 16, 18. In another embodiment, media transport 14 may alternatively be configured to move medium 12 in a first direction as indicated by arrow 32 during a first pass, to reverse its direction so as to move medium 12 backwards in a direction indicated by arrow 34 and to once again move medium 12 in the direction indicated by arrow 32 for an additional pass relative to print units 16, 18.

BACKGROUND

Page-wide array printers include an array of ink-dispensing nozzles fixed to a support. To clear paper jams or to service the printheads, the printheads may need to be removed or separated from the support. Such removal of the printheads from the support can be time consuming and tedious. Moreover, it may be difficult to precisely and accurately align and reattach the array of printheads to the support.

DETAILED DESCRIPTION OF EXAMPLE EMBODIMENTS

Figure 1:
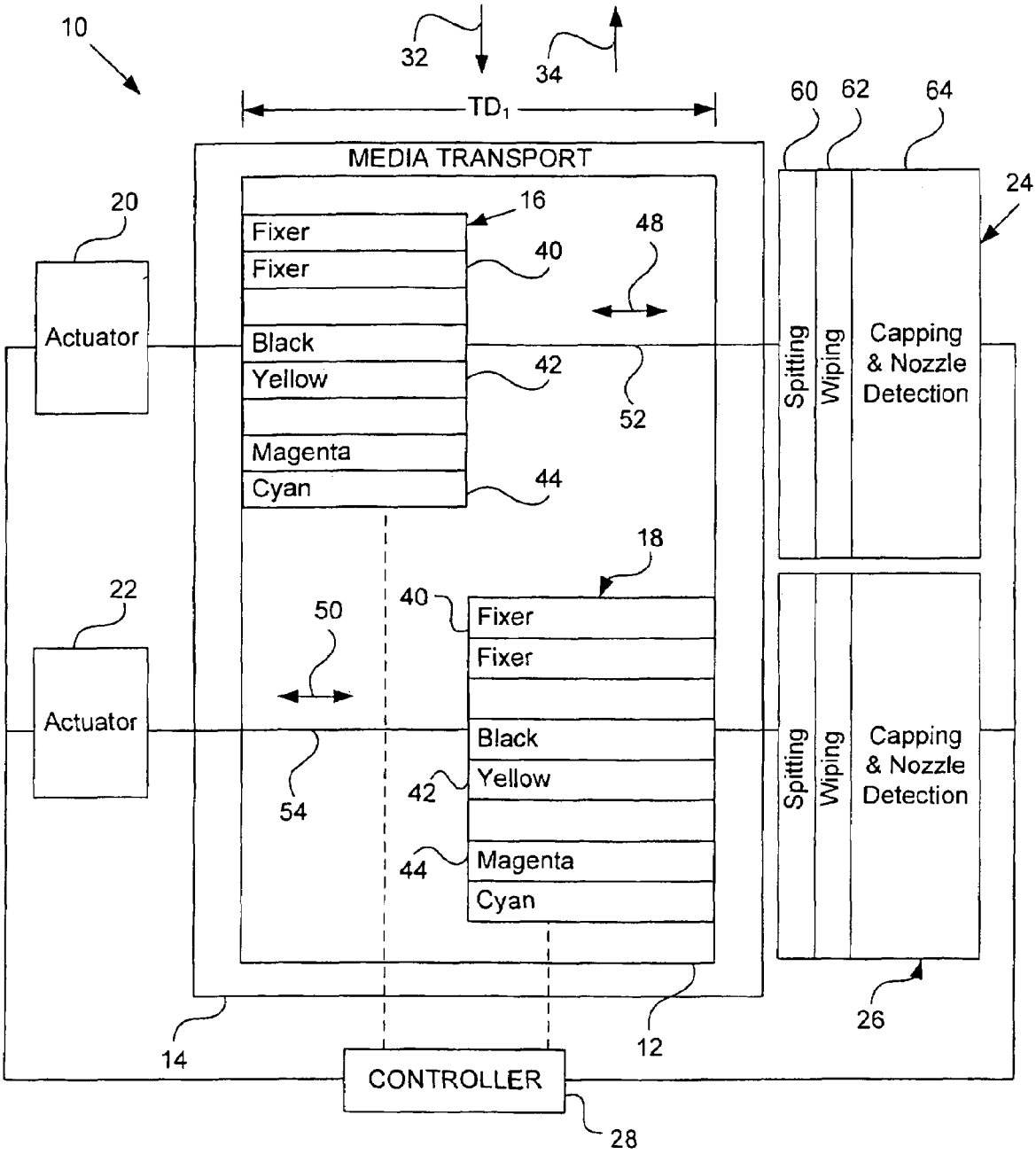
FIG. 1 is a schematic illustration of a media print system illustrating print units in first and second positions according to one exemplary embodiment.

FIG. 1 is a schematic illustration of media print system 10 according to one exemplary embodiment. Media print system 10 is configured to print or otherwise form images, such as illustrations, text and the like, upon a print medium 12 having a transverse dimension $TD_1$. In particular, system 10 is configured to print across the entire transverse dimension $TD_1$ in a single path of medium 12. In other embodiments, system 10 may alternatively be configured to print across an entire transverse print area of media 12 which may comprise a transverse dimension of media 12 less the left and right margins of media 12 which may be dedicated as non-printing areas.

Media print system 10 generally includes media transport 14, print unit 16, print unit 18, actuator 20, actuator 22, service station 24, service station 26 and controller 28. Media transport 14 comprises a device configured to move media 12 relative to print units 16 and 18. In particular, media transport 14 is configured to move media 12 in a longitudinal direction as indicated by arrow 32. Media transport 14 is further configured, according to some embodiments, to move media 12 through one or more passes relative to print units 16, 18. In one embodiment, media transport 14 may comprise a drum, a belt or a series of rollers configured to engage and rotate or wrap media 12 about one or more axes so as to move media 12 through one or more passes relative to print units 16, 18. In another embodiment, media transport 14 may alternatively be configured to move medium 12 in a first direction as indicated by arrow 32 during a first pass, to reverse its direction so as to move medium 12 backwards in a direction indicated by arrow 34 and to once again move medium 12 in the direction indicated by arrow 32 for an additional pass relative to print units 16, 18.

Print units 16 and 18 (also known as printhead carriages) comprise units configured to print or otherwise form images on a surface of medium 12. In the particular example shown, units 16 and 18 are configured to deposit a fluid, such as ink, upon medium 12. In the particular example shown, each of print units 16, 18 comprises a set of printheads for selectively ejecting and depositing distinct fluids upon medium 12. In the example shown, each of units 16, 18 includes printhead 40, printhead 42 and printhead 44. According to a specific, non-limiting example embodiment, each of printheads 40, 42 and 44 have a transverse width of at least 4.25 inches such that units 16,18 have a combined transverse width of 8.5 inches, enabling units 16 and 18 to simultaneously print across an entire transverse dimension $TD_1$ of a medium 12 having a transverse dimension of 8.5 inches. In other embodiments, the printheads of units 16 and 18 may have a transverse width of greater than or less than 4.25 inches.

In the particular example shown, printhead 40 is configured to print a clear fixer fluid. Printhead 42 is configured to print black and yellow inks. Printhead 44 is configured to print magenta and cyan inks. In other embodiments, printer units 16, 18 may include a greater or fewer number of such printheads. In other embodiments, the printheads of units 16 and 18 may be alternatively configured to print other fluids or other colors of ink. According to one exemplary embodiment, each of printheads 40, 42 and 44 comprise inkjet printheads. In other embodiments, other fluid dispensing mechanisms may be employed to eject or otherwise deposit ink or other fluid upon medium 12.

Actuators 20 and 22 comprise mechanisms configured to transversely move print units 16 and 18 in the directions indicated by arrows 48 and 50 along axes 52 and 54, respectively, relative to medium 12. In one embodiment, actuators 20 and 22 may comprise electrical motors which drive a belt connected to units 16 and 18 to move units 16 and 18 along a rod or bar (not shown). In still other embodiments, actuators 20 and 22 may comprise other devices configured to move units 16 and 18. Although units 16 and 18 are illustrated as having distinct actuators 20, 22, units 16 and 18 may alternatively be driven by a single actuator.

Service stations 24 and 26 comprise stations configured to service units 1-6 and 18, respectively. In the particular example shown in which printheads 40, 42 and 44 include multiple fluid ejecting nozzles 574 (shown in FIG. 7), service stations 24 and 26 are configured to perform multiple servicing operations. Service stations 24 and 26 each include a spitting substation 60, a wiping substation 62 and a capping and nozzle detection substation 64. Substation 60 comprises a blotter configured to absorb ink or other fluid fired or spit from the nozzles of printheads 40, 42 and 44. In one embodiment, substation 60 includes a fiber or other absorbing material. In other embodiments, substation 60 may omit a blotter.

Wiping substation 62 includes one or more tools configured to apply fluid, such as a solvent, to the nozzles of printheads 40, 42 and 44 and to wipe or otherwise remove the applied solvents from the nozzles. In one embodiment, substation 62 may include a solvent pad formed from a compliant material such as tight-celled foam sponge. Examples of solvents that may be applied include water for water-based inks or reactive solvents such as polyethylene glycol. Substation 62 may additionally include a compliant or elastomeric blade or an absorbent cloth configured to remove fiber or other foreign materials off of the surface of the nozzles of printheads 40, 42 and 44 and to remove remaining solvent. In other embodiments, wiping substation 62 may merely include the blade while omitting the application of wiping station fluid.

Capping and nozzle detection substation 64 is configured to cap the nozzles of printheads 40, 42 and 44 at the end of servicing. Prior to printing, substation 24 uncaps the printheads to enable additional printing. Substation 64 is further configured to detect or otherwise identify the health of the nozzles of printheads 40, 42 and 44. According to one embodiment, the nozzles of printheads 40, 42 and 44 are fired and the resulting ejection of ink is detected to identify clogged or malfunctioning nozzles. Although service stations 24 and 26 are illustrated as performing each of the aforementioned servicing operations, servicing stations 24 and 26 may alternatively be configured to perform a fewer or greater number of such servicing operations.

Controller 28 generally comprises a processor unit in communication with media transport 14, print units 16, 18, actuators 20, 22 and service stations 24, 26. For purposes of the disclosure, the term "processing unit" shall include a conventionally known or future developed processing unit that executes sequences of instructions contained in a memory. Execution of the sequences of instructions causes the processing unit to perform steps such as generating control signals. The instructions may be loaded in a random access memory (RAM) for execution by the processing unit from a read only memory (ROM), a mass storage device, or some other persistent storage. In other embodiments, hard wired circuitry may be used in place of or in combination with software instructions to implement the functions described. Controller 28 is not limited to any specific combination of hardware circuitry and software, nor to any particular source for the instructions executed by the processing unit.

In the particular embodiment shown, controller 28 receives feedback in the form of electrical signals from media transport 14, actuators 20, 22, print units 16, 18 and service stations 24 and 26 and generates control signals which direct the operation of media transport 14, print units 16,18, actuators 20, 22 and service stations 24, 26. For example, controller 28 may receive signals from an encoder of media transport 14, wherein the signals indicate the positioning of media. Based upon the sensed position of the media, controller 28 directs print units 16, 18 as well as actuators 20 and 22 to print upon the media. Based upon the sensed need for servicing, controller 28 may generate control signals directing actuators 20, 22 to reposition print units 16, 18 to service stations 24, 26. Controller 28 further generates control signals directing the operation of one or both of service stations 24, 26.

In one embodiment, controller 28 may communicate via wires. In another embodiment, controller 28 may communicate the infrared, RF or other wireless signals. In one embodiment, controller 28 may be provided as part of a printer. In another embodiment, controller 28 may be provided as part of computer, network or other device connected to printer including one or more of the remaining components of print system 10.

As shown by FIG. 1, controller 28 is configured to generate control signals which direct actuators 20 and 22 to move print units 16 and 18 along axes 52 and 54, respectively, relative to one another and relative to print medium 12. In the example shown in FIG. 1, controller 28 generates control signals causing actuators 20 and 22 to position print units 16 and 18 at offset positions relative to one another such that print units 16 and 18, together, span the entire transverse dimension $TD_1$ of medium 12 or at least an entire print area or print range of medium 12 ($TD_1$ less margins). Controller 28 further generates control signals directing media transport 14 to move medium 12 in the direction indicated by arrow 32. As a result, the entire transverse dimension $TD_1$ or at least the entire transverse print range or area of medium 12 may be printed upon during a single pass of medium 12.

Figure 2:
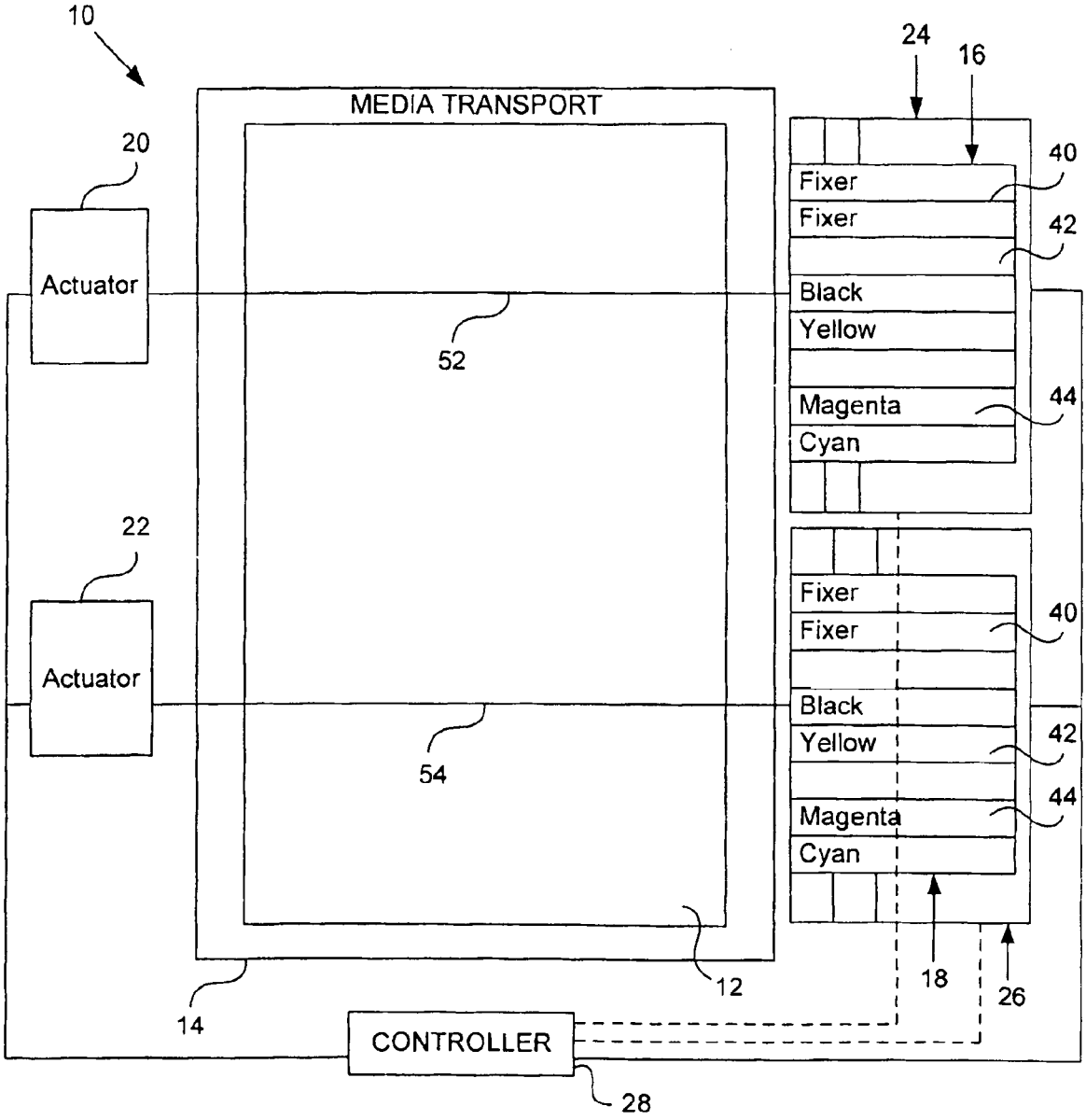
FIG. 2 is a schematic illustration of the system of FIG. 1 illustrating the print units in withdrawn positions according to one exemplary embodiment.

As shown by FIG. 2, controller 28 is further configured to generate control signals which direct actuators 20 and 22 to move and withdraw print units 16 and 18 from medium 12 to withdrawn positions at service stations 24 and 26, respectively. Because controller 28 and actuators 20 and 22 are configured to move print units 16 and 18 to withdrawn positions, servicing and/or repair of media transport 14 is facilitated. In addition, print units 16 and 18 do not obstruct or interfere with clearing or removal of jammed media 12. Moreover, because print units 16 and 18 may be moved to withdrawn positions, print units 16 and 18 may be more easily removed from print system 10 for servicing, repair or replacement.

Because controller 28 and actuators 20, 22 are configured to move print units 16, 18 to service stations 24 and 26, respectively, withdrawn from media 12, servicing of print units 16, 18 is facilitated without moving or separating print units 16, 18 from a support, carriage, slide rod or other structure associated with actuators 20 and 22 and supporting units 16, 18. In particular, service stations 24 and 26 enable spitting, wiping and capping operations to be formed on each of the printheads of print units 16 and 18 and also enable health of the nozzles of print units 16 and 18 to be determined without removing, realigning, and reattaching units 16 and 18 upon the completion of servicing. At the same time, units 16 and 18 enable the entire transverse dimension $TD_1$ or at least the entire transverse print area or print range of medium 12 to be simultaneously printed upon in a single pass.

Figure 3A:
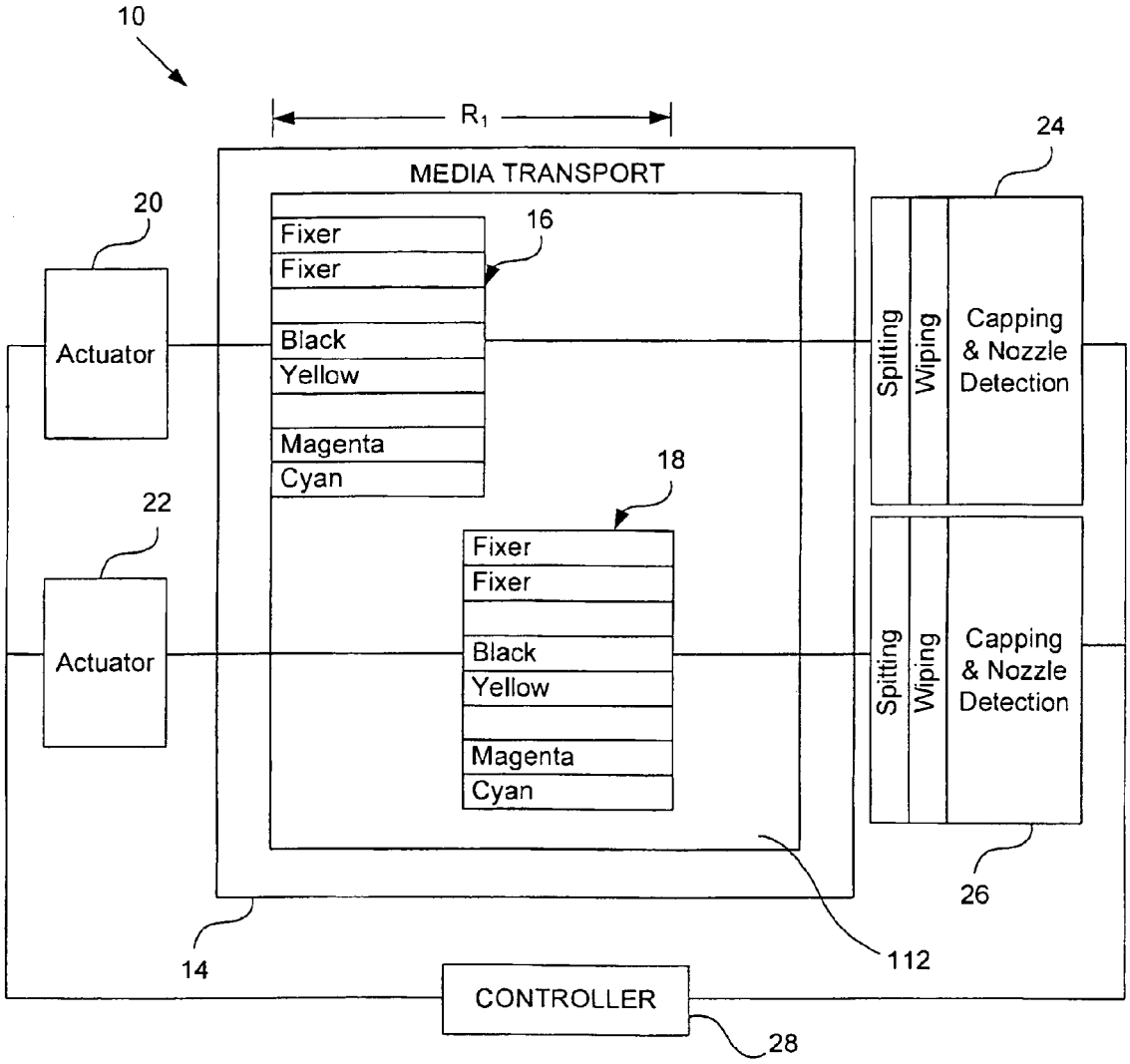
FIG. 3A is a schematic illustration of the system of FIG. 1 illustrating the print units in the first and second positions while printing upon a second wider medium.
Figure 3B:
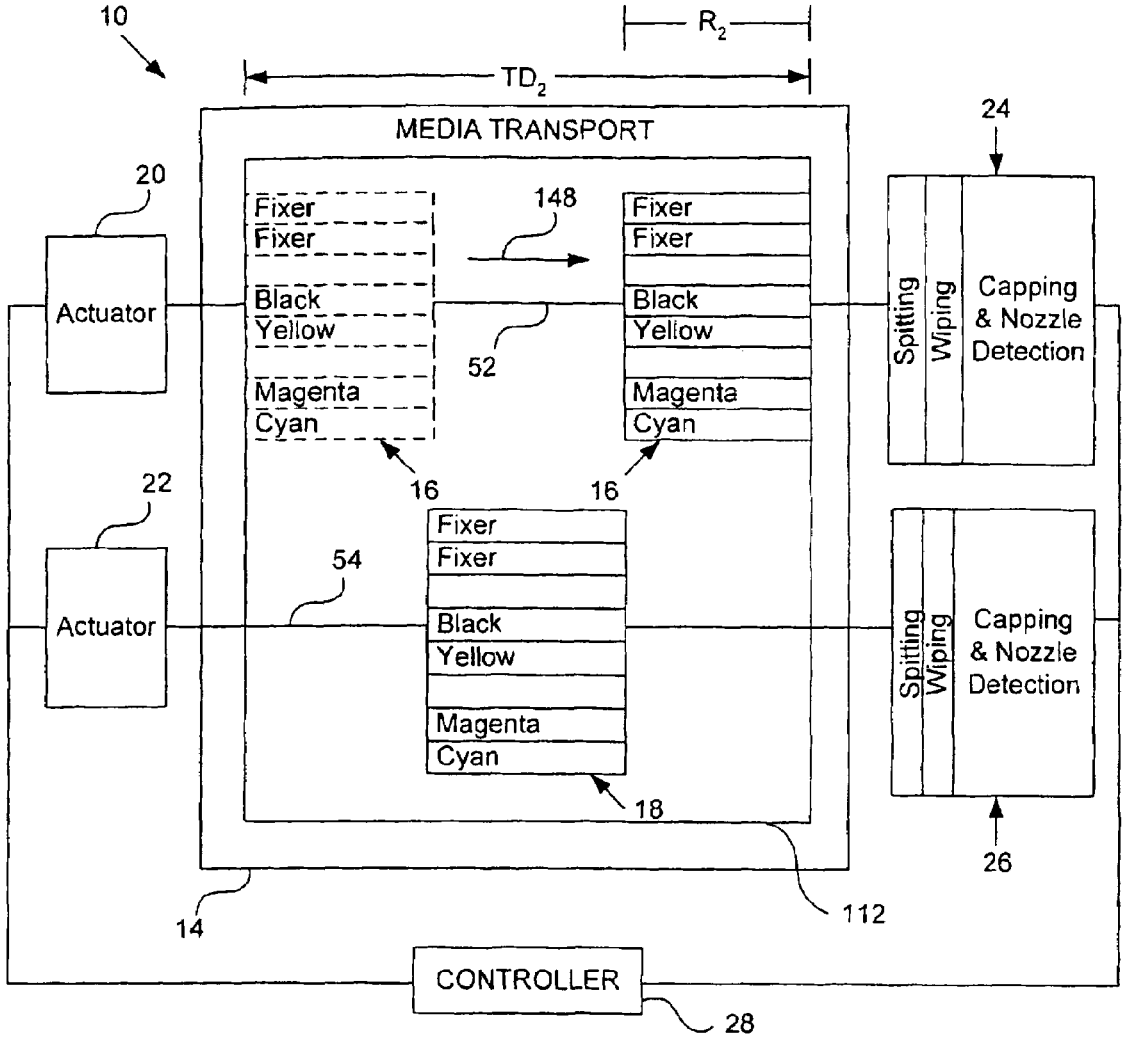
FIG. 3B is a schematic illustration of the system of FIG. 3A illustrating the movement of one of the print units to a third position.

FIGS. 3A and 3B schematically illustrate media print system 10 printing or otherwise forming an image upon an alternative medium 112 having a transverse dimension $TD_2$ which is generally greater than the combined transverse widths of print units 16 and 18. In the particular example shown, medium 112 has a total transverse dimension $TD_2$ of approximately 12.75 inches. To print across the entire transverse dimension $TD_2$, units 16 and 18 print upon a first portion of medium 112 during a first pass shown in FIG. 3A and a second portion of medium 112 during a second pass as shown in FIG. 3B. In particular, controller 28 generates control signals which direct actuators 20 and 22 to position print units 16 and 18 such that print units 16 and 18 transversely span transverse region $R_1$. In one embodiment, controller 28 directs actuators 20 and 22 to position print units 16 and 18 such that print units 16 and 18 partially overlap-one another. Controller 28 further generates control signals which direct media transport 14 to move media 112 through a first pass relative to print units 16 and 18 while print units 16 and 18 are directed by controller 28 to eject fluid upon medium 112.

As shown by FIG. 3B, upon completion of the first path shown in FIG. 3A, controller 28 generates control signals which direct actuator 20 to move print unit 16 relative to print unit 18 in the direction indicated by arrow 148 such that print unit 16 is located so as to print upon transverse region $R_2$ of medium 112, wherein $R_1$ and $R_2$ have a dimension of at least $TD_2$ or, alternatively, at least a printable width of medium 112. Controller 28 further generates control signals directing media transport 14 to move medium 112 through a second pass while also directing print unit to eject fluid or otherwise print an image upon transverse region $R_2$ of medium 112. In particular scenarios, controller 28 may further generate control signals directing print unit 18 to eject fluid or otherwise form additional imaging upon print medium 112. As a result, medium print system 10 may also be utilized to print or otherwise form images upon media having a transverse dimension or transverse printable area greater than the combined transverse width of print units 16, 18. Although FIG. 3B depicts a scenario wherein only print unit 16 is moved, controller 28 may also be configured to generate control signals directing actuator 22 to transversely move print unit 18 in yet another position to accommodate even a wider medium or to overprint previously printed upon portions.

Figure 4:
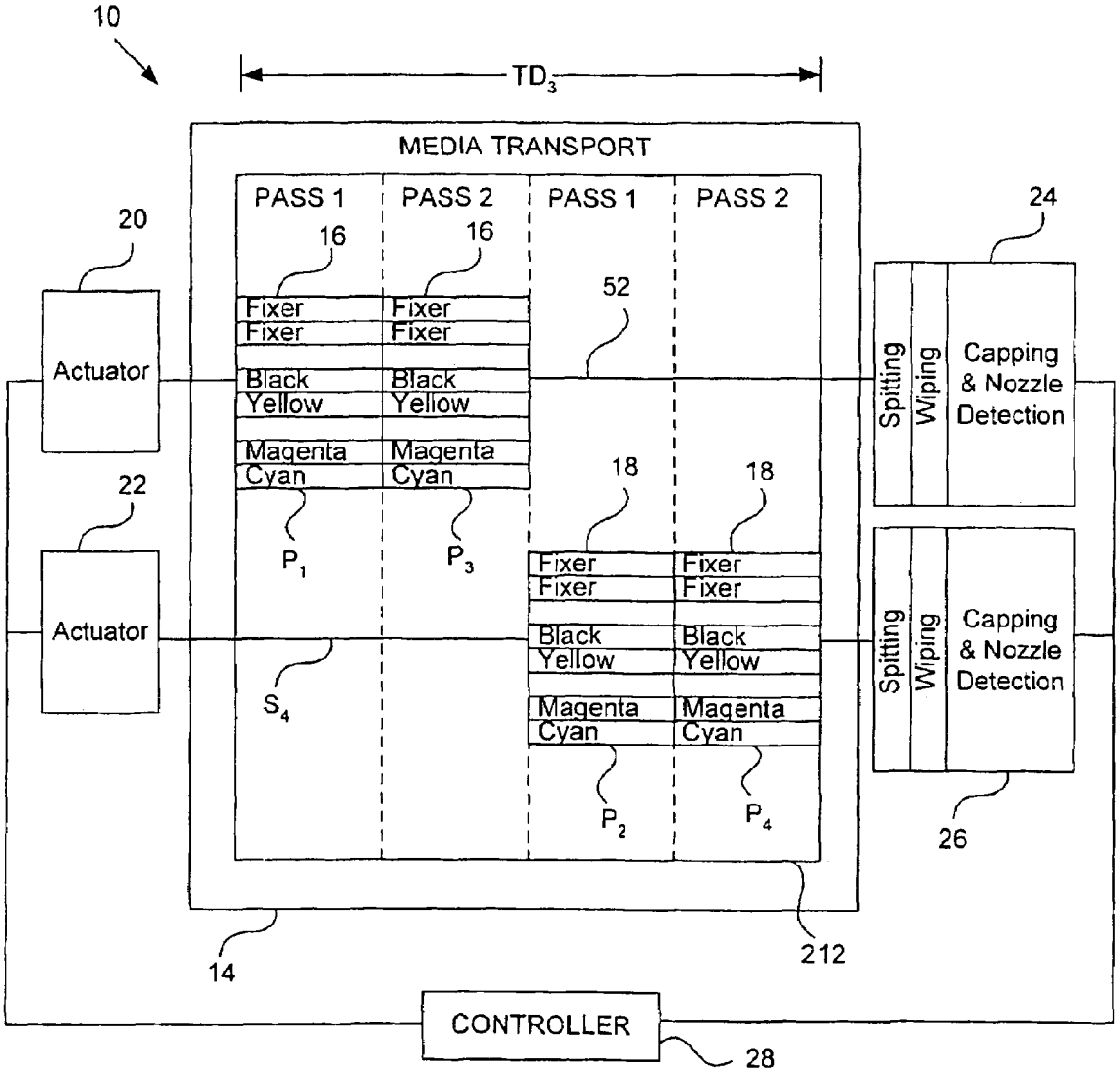
FIG. 4 is a schematic illustration of the system of FIG. 1 illustrating positioning of the print units during passes across a third medium.

FIG. 4 is a schematic illustration of media print system 10 printing upon medium 212. In the example shown, controller 28 generates control signals directing actuators 20 and 22 to move print units 16 and 18 to positions $P_1$ and $P_2$, respectively, transversely spaced from one another. Controller 28 further generates control signals directing media transport 14 to longitudinally move medium 112 through pass 1 while print units 16 and 18 print upon medium 212.

Once pass 1 has been completed, controller 28 generates control signals directing media transport 14 to reposition medium 212 relative to print units 16 and 18 for movement through a second pass. In one embodiment, controller 28 continuously rotates medium 212 about one or more axes. In another embodiment, controller 28 generates control signals directing media transport 14 to reverse the direction of movement of medium 212. Controller 28 further generates control signals directing actuators 20 and 22 to reposition print units 16 and 18 to positions $P_3$ and $P_4$, respectively. Controller 28 also generates control signals directing media transport 14 to move medium 212 through pass 2 while also directing print units 16 and 18 to print upon medium 212. As a result, media print system 10 may print an image across an entire transverse dimension $TD_3$ of medium 212 having a dimension greater than the combined width of print units 16 and 18 with two passes of medium 212. Because units 16 and 18 are spaced from one another while printing during passes 1 and 2, print units 16 and 18 do not overlap one another during any one pass and the potential for inks applied by print units 16 and 18 during a single pass blending or bleeding into one another prior to becoming fixed or dried is reduced.

Figure 5:
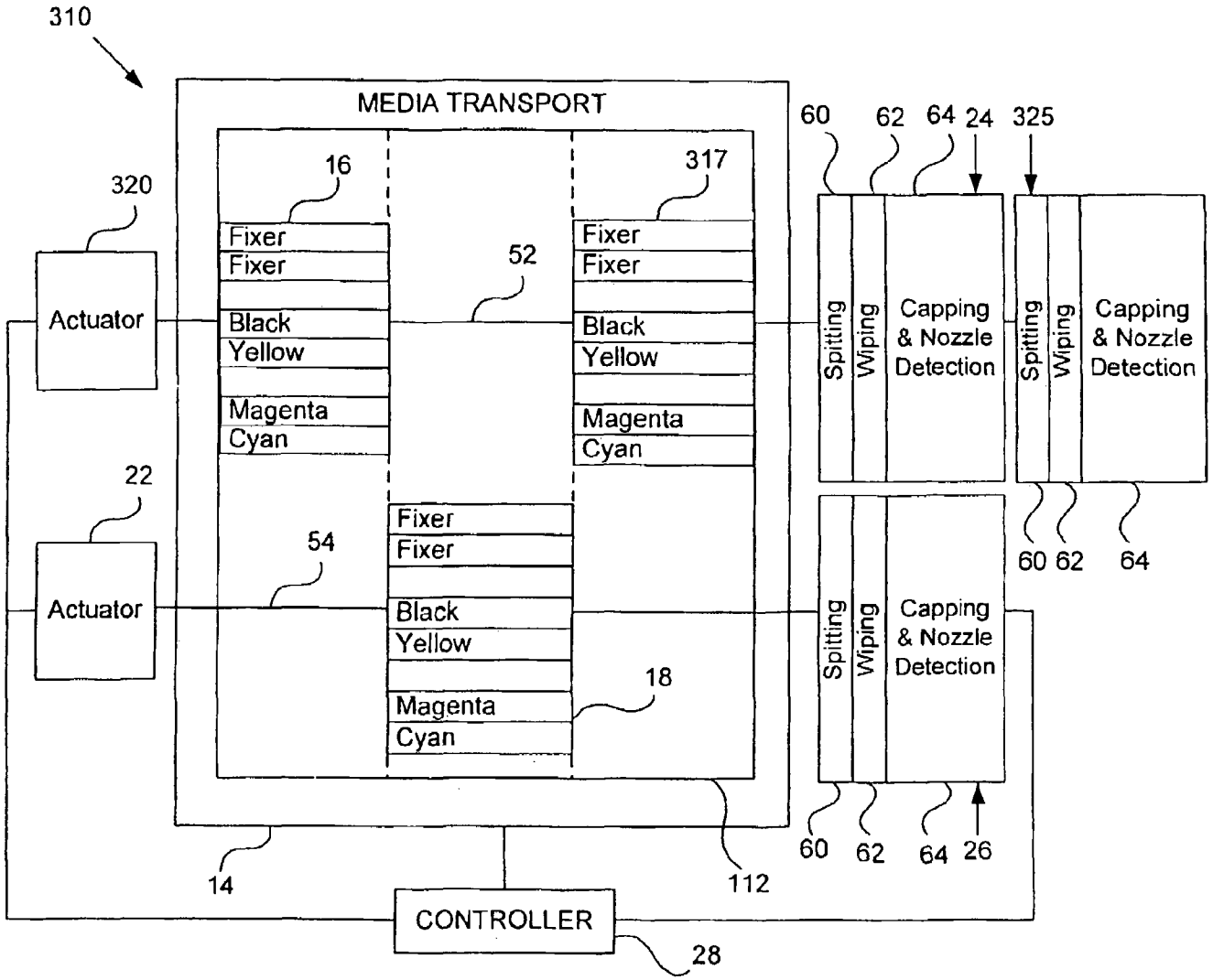
FIG. 5 is a schematic illustration of a second embodiment of the media print system of FIG. 1 according to one exemplary embodiment.

FIG. 5 schematically illustrates media print system 310, another embodiment of media print system 10. Media print system 310 is similar to media print system 10 except that media print system 310 includes actuator 320 in lieu of actuator 20 and additionally includes print unit 317. Those remaining elements of media print system 310 which correspond to elements of media print system 10 are numbered similarly.

Actuator 320 is similar to actuator 20 except that actuator 320 is configured to move print units 16 and 317 along a common axis 52. In one embodiment, actuator 320 is configured to move print units 16 and 317 in unison along axis 52. In another embodiment, actuator 320 is configured to move print units 16 and 317 relative to one another along axis 52. According to one exemplary embodiment, actuator 320 may include a pair of individual electric motors configured to rotatably drive a pair of respective belts connected to units 16 and 317 so as to move units 16 and 317 along a guide such as a slide bar or a rod (not shown) extending along axis 52.

Print unit 317 is substantially identical to print units 16 and 18. In one embodiment, print unit 317 has a transverse width of at least about 4.25 inches. As a result, print units 16, 18 and 317, together, have a combined transverse width of 12.75 inches, enabling media print system 310 to simultaneously print across medium 212 in a single pass of medium 212 by media transport 14. Because print units 16 and 317 are movable along a common axis 52, media print system 310 compact.

Servicing station 325 is substantially identical to servicing station 24. Servicing station 325 is positioned along axis 52 beside service station 24. Service 325 is configured to receive and service print unit 317. Print units 16 and 18 of media print system 10, print units 16, 18 and 317 of media print system 310 may be moved by actuators 320 and 22 to withdrawn positions, enabling media transport 14 to be serviced and facilitate the clearing of media jams. At the same time, print units 16,18 and 317 may be serviced without being removed or separated from media print system 310 or actuators 320 and 22.

Figure 6A:
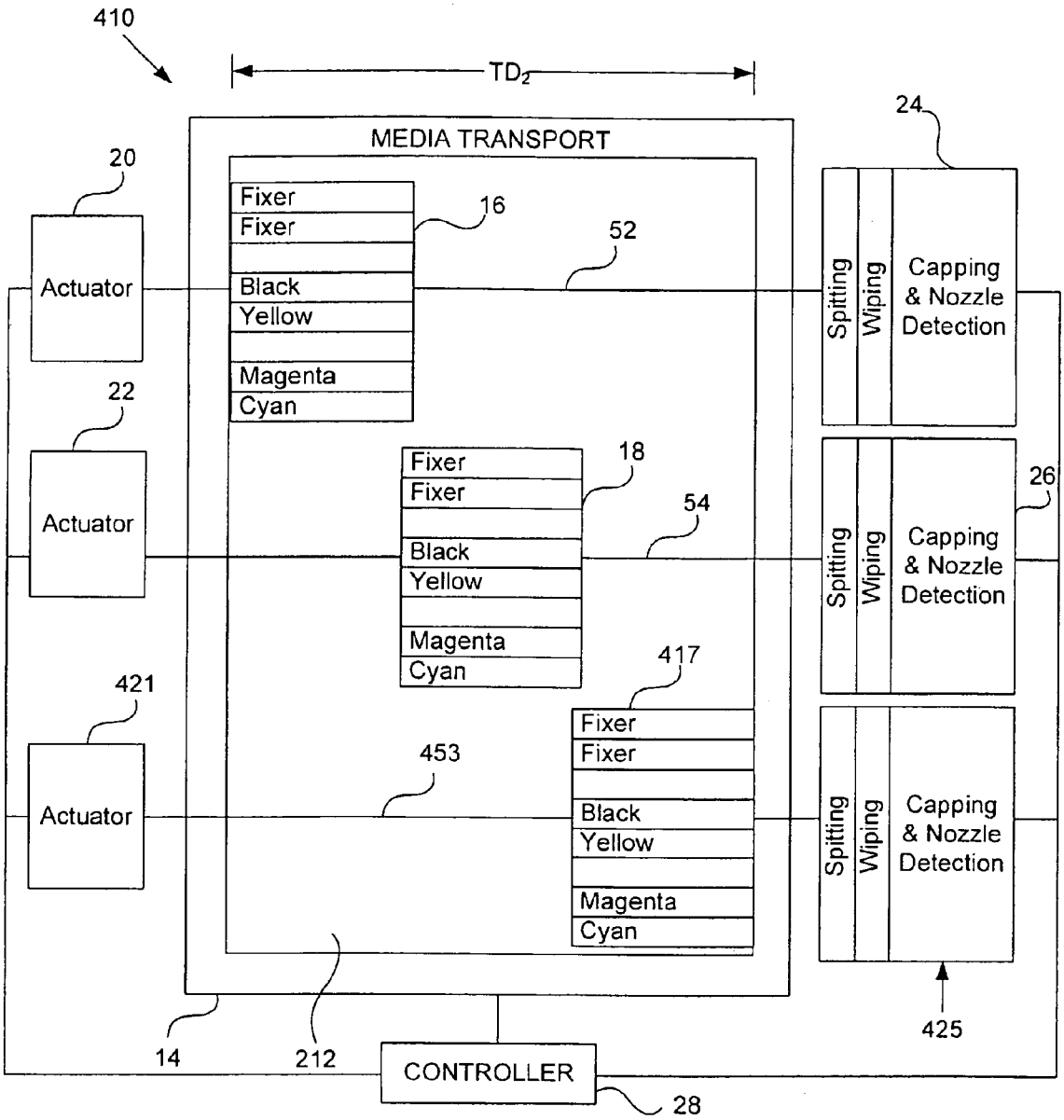
FIG. 6A is a schematic illustration of a third embodiment of the media print system of FIG. 1 during a first pass according to one exemplary embodiment.

FIG. 6A schematically illustrates media print system 410, another embodiment of media print system 10. Media print system 410 is similar to media print system 10 except that media print system 410 additionally includes print unit 417, actuator 421 and service station 425. Print unit 417 is substantially identical to print units 16 and 18 except that print unit 417 is longitudinally offset relative to print units 16 and 18. Actuator 421 is similar to actuators 20 and 22 except that actuator 421 is configured to transversely move print unit 417 along axis 453 relative to medium 212 and service station 425. Service station 425 is substantially identical to service stations 24 and 26 and is configured to service unit 417. Service station 425 is located along axis 453 and receives print unit 417 when print unit 417 is moved by actuator 421 to a withdrawn position for servicing of print unit 417, for nozzle health detection of print unit 417 and for clearing of media jams.

In the scenario illustrated in FIG. 6A, controller 28 generates control signals directing actuators 20, 22 and 421 to transversely move print units 16, 18 and 417, respectively, to the transversely staggered positions. In the staggered positions, print units 16, 18 and 417, together, transversely span the entire transverse dimension $TD_2$ of medium 212. In one embodiment, print units 16, 18 and 417 may slightly overlap one another. Controller 28 further generates control signals directing media transport 14 to longitudinally move medium 212 while also directing one or more print units 16, 18 and 417 to eject ink or otherwise print upon medium 212. As a result, media print system 410 simultaneously prints across the entire transverse dimension $TD_2$ of medium 212 in a single pass of medium 212.

Figure 6B:
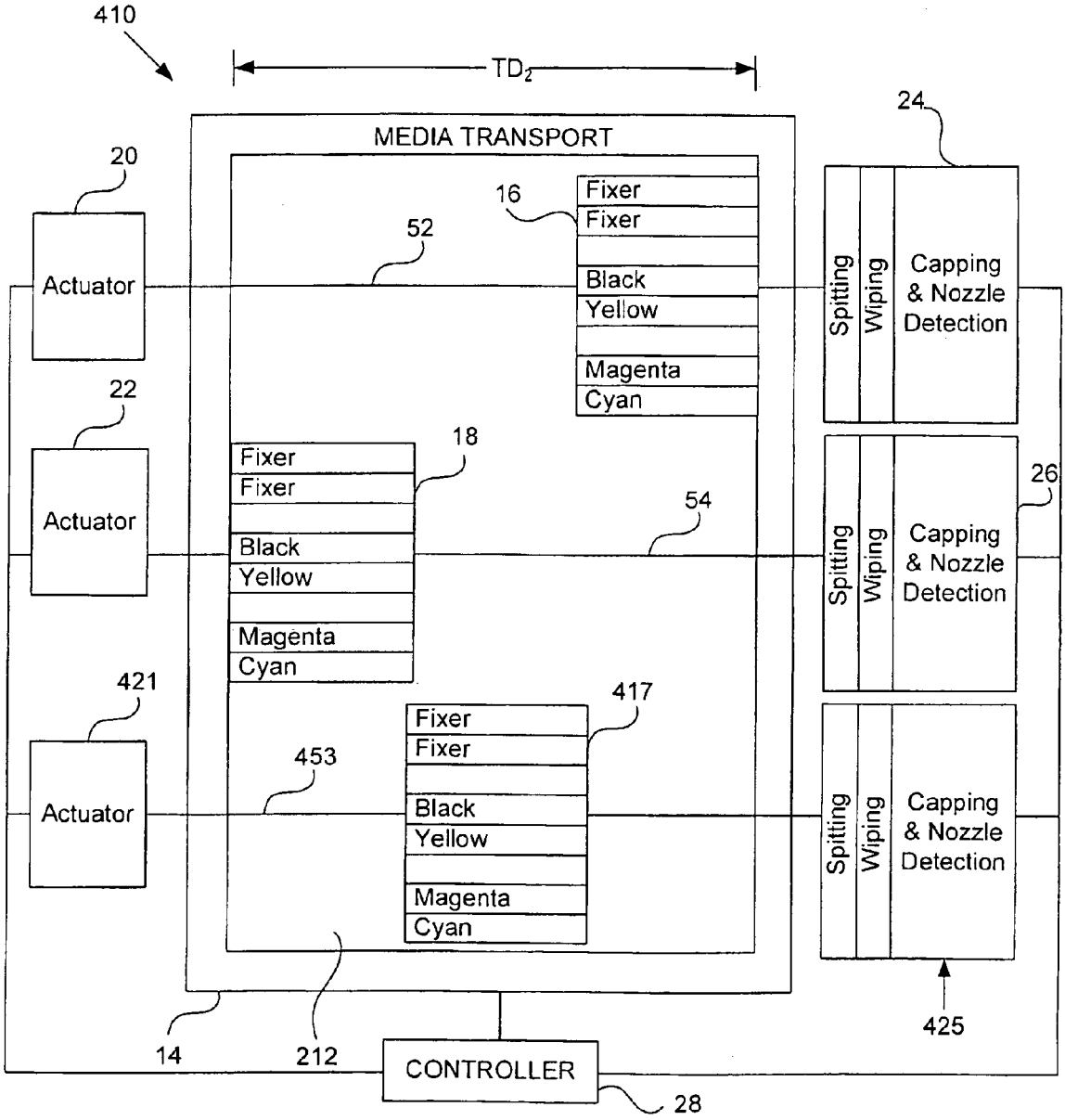
FIG. 6B is a schematic illustration of the media print system of FIG. 6A illustrating repositioning of print units during a second pass according to one exemplary embodiment.

FIG. 6B illustrates media print system 410 during a second pass of the medium 212 relative to print units 16, 18 and 417. In the scenario shown in FIG. 6B, higher quality printing may be achieved by printing over the same area of medium 212 several times to reduce issues with color, optical density and reduce coalescence. As shown by FIG. 6B, during the second pass, print units 16, 18 and 417 are repositioned so as to print across the regions of medium 212 which were printed upon by another print unit during the first printing pass. As a result, errors caused by the malfunctioning of portions of one or more of printheads 16, 18 and 417 are hid. For example, if a particular nozzle of print unit 16 is malfunctioning, the unprinted upon portion of medium 212 may be printed upon by a properly functioning nozzle of print unit 18 during the second printing pass. In this manner, malfunctioning nozzles or other image-forming portions associated with a particular print unit may be corrected or addressed by repositioning the other print units. In lieu of hiding a printing omission caused by a malfunctioning nozzle or printing component of a first print unit with a properly functioning nozzle or printing component of a second print unit, such errors may be corrected by indexing each print unit through a small distance along axes 52, 54 and 453 such that printing errors caused by malfunctioning nozzles or print components of a first print unit are addressed or corrected using properly functioning nozzles or printing portions of the same print unit.

Figure 7:
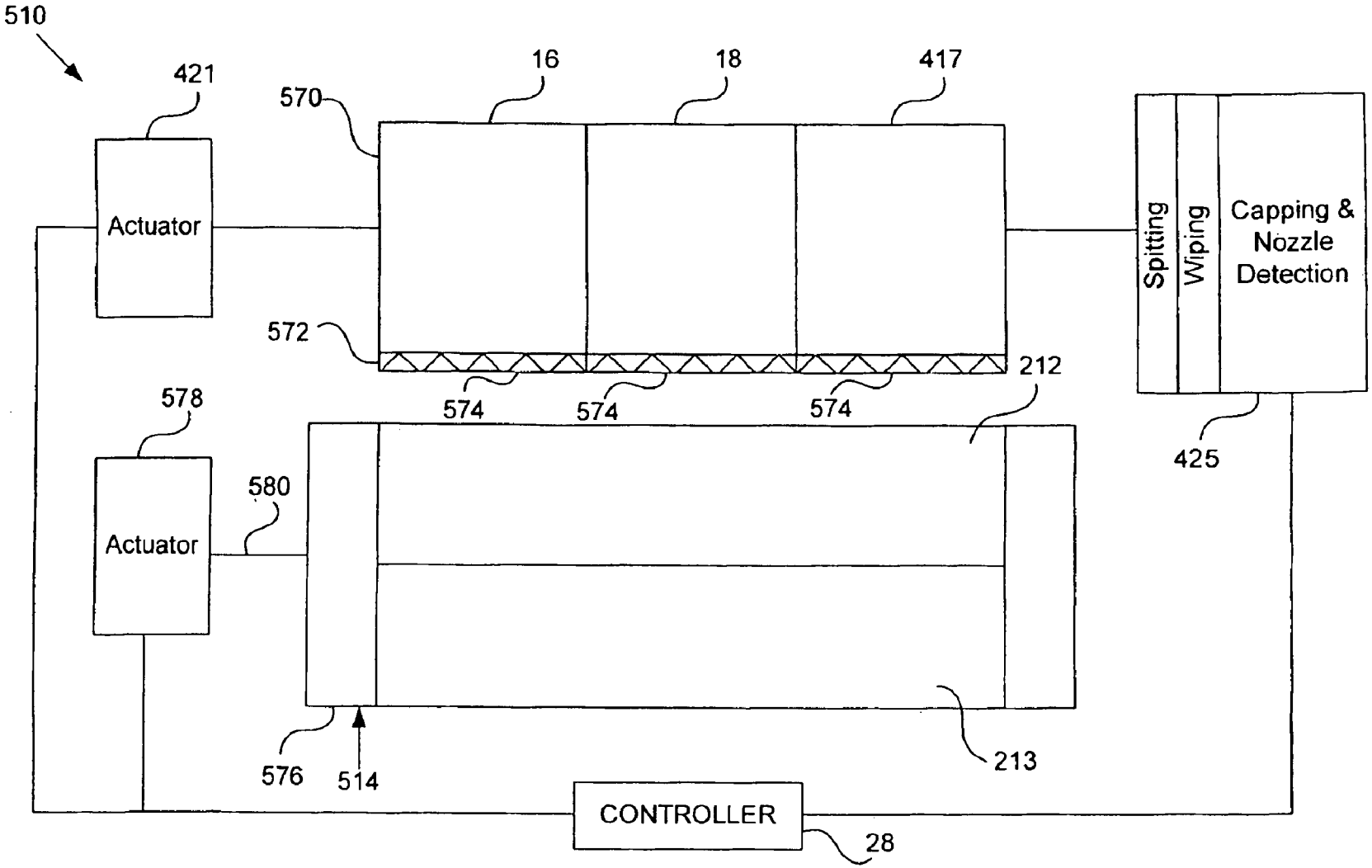
FIG. 7 is a side elevational view schematically illustrating an example of the media print system of FIG. 6 according to one exemplary embodiment.

FIG. 7 is a side elevational view schematically illustrating media print system 510, one example of media print system 410 shown in FIG. 6. Media print system 510 includes media transport 514, print units 16, 18 and 417, actuators 20, 22 (shown in FIG. 6) and 421, service stations 24, 26 (shown in FIG. 6) and 425, and controller 28. As shown by FIG. 7, in one embodiment, print units 16, 18 and 417 each include ink reservoirs 570 and printheads 572. Printheads 572 each include a plurality of nozzles 574 (schematically illustrated) through which ink is ejected onto media 212 and 213.

As further shown by FIG. 7, media transport 514 includes drum 576 and actuator 578. Drum 576 generally comprises an elongate cylinder configured to be rotated about axis 580. Drum 576 is further configured to support one or more sheets of media, such as media 212 and 213, which wrap about an exterior surface of drum 576. In one embodiment, drum 576 may include vacuum source and one or more surface vacuum ports for drawing and holding media to drum 576. In particular embodiments, drum 576 may additionally include internal heaters for heating the surface of drum 576 to facilitate the drying of the ink upon the media supported by drum 576.

Actuator 578 comprises a rotary actuator configured to rotatably drive drum 576 about axis 580. In operation, controller 28 generates control signals which direct actuator 578 to rotate drum 576 about axis 580 while media 212 and 213 are wrapped about drum 576. Each revolution of drum 576 about axis 580 completes a single pass of media 212 and 213 relative to print units 16, 18 and 417. Because media transport 514 rotates media 212 and 213 about axis 580, media 212 and 213 do not need to be reversed or backed up for being printed upon during subsequent passes.

Overall, media print systems 10, 310, 410 and 510 enable simultaneous printing upon an entire transverse direction of a medium during a single pass of the medium. At the same time, systems 10, 310, 410 and 510 also enable mediums having transverse dimensions greater than the combined transverse width of the multiple print units to be printed upon. Because systems 10, 310, 410 and 510 enable print units 16, 18 and 417 to be withdrawn from the medium, media transport 14, 514 may be serviced and media or paper jams may be cleared without interference from print units. Moreover, systems 10, 310, 410 and 510 also enable print units 16, 18, 317 and 417 to be withdrawn from the medium for servicing without detaching such print units from their actuators and without realigning during reattachment.

Although the present invention has been described with reference to example embodiments, workers skilled in the art will recognize that changes may be made in form and detail without departing from the spirit and scope of the invention. For example, although different example embodiments may have been described as including one or more features providing one or more benefits, it is contemplated that the described features may be interchanged with one another or alternatively be combined with one another in the described example embodiments or in other alternative embodiments. Because the technology of the present invention is relatively complex, not all changes in the technology are foreseeable. The present invention described with reference to the example embodiments and set forth in the following claims is manifestly intended to be as broad as possible. For example, unless specifically otherwise noted, the claims reciting a single particular element also encompass a plurality of such particular elements.

What is claimed is:

1. A media print system comprising:

a first print unit;

a second print unit;

at least one actuator configured to move the first unit and the second unit relative to one another; and a controller configured to generate control signals, wherein the at least one actuator positions the first unit and the second unit at first and second positions, respectively, during a first longitudinal pass of a medium and positions the first unit at a third position during a second pass of the medium in response to the control signals, wherein the first print unit and the second print unit transversely move relative to the medium along a common axis.

2. The system of claim 1, wherein the first print unit and a second print unit are movable relative to one another and wherein the first print unit and the second print unit, together, have a transverse width of at least 8.5 inches.

3. The system of claim 1, wherein the first print unit and a second print unit are movable relative to one another and wherein the first print unit has a transverse width of at least 4.25 inches.

4. The system of claim 1 including a first service station along the axis and a second service station along the axis.

5. The system of claim 4, wherein the first print unit and a second print unit are movable relative to one another and wherein the first print unit and the second print unit, together, have a transverse width of at least 8.5 inches.

6. The system of claim 4, wherein the first service station and the second service station extend across the axis.

7. The system of claim 1, wherein the media transport is configured to rotate the medium about at least one transverse axis.

8. The system of claim 7, wherein the media transport comprises a drum.

9. The system of claim 8, wherein the media transport is configured such that the medium curves and wraps at least partially about the drum.

10. The system of claim 1, wherein the first print unit and the second print unit are transversely spaced from one another when in the first and second positions.

11. The system of claim 10, wherein the third position is between the first position and the second position.

12. The system of claim 1 including a third print unit configured to print upon the medium, wherein the at least one actuator is configured to transversely move the third unit relative to the first unit and the second unit and relative to the medium.

13. The system of claim 12 including a third service station configured to service the third print unit.

14. The system of claim 1, wherein the third position is partially coextensive with the first position.

15. The system of claim 1, including a media transport configured to longitudinally move the medium having a transverse dimension and wherein the first print unit and the second print unit, together, have a transverse width no less than the transverse dimension of the medium.

16. The system of claim 15, wherein the at least one actuator is configured to position the first print unit at a fourth position withdrawn from the medium and the second print unit at a second position withdrawn from the medium.

17. The system of claim 1 further comprising a media transport, wherein the controller is configured to generate control signals causing the media transport to move the medium opposite to the first print unit and the second print unit during the first pass of the medium and to move the medium opposite to the first print unit and the second print unit during the second pass of the medium.

18. The system of claim 1, wherein the first print unit and the second print unit move relative to one another and wherein both the first print unit and the second print unit extend across the common axis.

19. The system of claim 1, wherein the first print unit includes a plurality of different colors of ink serially arranged in a first direction in which the medium passes.

20. The system of claim 19 further comprising a service station having wiping and capping sections serially arranged in a second direction substantially perpendicular to the first direction.

21. A media print system comprising:

a first print unit;

a second print unit, wherein the first print unit and the second print unit, together, have a transverse width no less than a transverse dimension of a medium; and at least one actuator configured to transversely move the first print unit to a first position withdrawn from the medium and to move the second print unit to a second position withdrawn from the medium.

22. The system of claim 21 including a first servicing station, wherein the first print unit is at the first servicing station in the first position.

23. The system of claim 22 including a second service station, wherein the second printing unit is at the second service station when in the second position.

24. The system of claim 22, wherein the first print unit includes nozzles through which ink is ejected and wherein the service station is configured to determine nozzle health.

25. The system of claim 22, wherein the first service station is configured to form a capping operation.

26. The system of claim 22, wherein the first service station is configured to form a wiping operation.

27. The system of claim 22, wherein the first service station is configured to perform a spilling operation.

28. A media print system comprising:

a first print unit;

a second print unit;

at least one actuator configured to move the first unit and the second unit relative to one another; and a controller configured to generate control signals, wherein the at least one actuator positions the first unit and the second unit at first and second positions, respectively, during a first longitudinal pass of a medium and positions the first unit at a third position during a second pass of the medium in response to the control signals, wherein the first print unit and the second print unit are transversely spaced from one another when in the first and second positions.

29. A media print system comprising:

a first print unit;

a second print unit;

at least one actuator configured to move the first unit and the second unit relative to one another;

a controller configured to generate control signals, wherein the at least one actuator positions the first unit and the second unit at first and second positions, respectively, during a first longitudinal pass of a medium and positions the first unit at a third position during a second pass of the medium in response to the control signals, wherein the first print unit includes a plurality of different colors of ink serially arranged in a first direction in which the medium passes; and a service station having wiping and capping sections serially arranged in a second direction substantially perpendicular to the first direction.

30. The system of claim 29, wherein the first print unit and the second print unit transversely move relative to the medium along a common axis.

31. The system of claim 30, wherein the first service station and the second service station extend along and across the axis.

32. The system of claim 30, wherein the first print unit and the second print unit extend across the common axis.

33. The system of claim 29, wherein the first print unit and the second print unit are transversely spaced from one another when in the first and second positions.

* * * * *

UNITED STATES PATENT AND TRADEMARK OFFICE

CERTIFICATE OF CORRECTION

PATENT NO. : 7,654,635 B2
APPLICATION NO. : 10/988902
DATED : February 2, 2010
INVENTOR(S) : Ronald A. Askeland et al.

It is certified that error appears in the above-identified patent and that said Letters Patent is hereby corrected as shown below:

In column 1, lines 6-28, delete "Media print system 10 generally includes media transport 14, print unit 16, print unit 18, actuator 20, actuator 22, service station 24, service station 26 and controller 28. Media transport 14 comprises a device configured to move media 12 relative to print units 16 and 18. In one embodiment, media transport 14 is configured to longitudinally move a first medium having a first transverse dimension and a second medium having a second greater transverse dimension. In particular, media transport 14 is configured to move media 12 in a longitudinal direction as indicated by arrow 32. Media transport 14 is further configured, according to some embodiments, to move media 12 through one or more passes relative to print units 16, 18. In one embodiment, media transport 14 may comprise a drum, a belt or a series of rollers configured to engage and rotate or wrap media 12 about one or more axes so as to move media 12 through one or more passes relative to print units 16, 18. In another embodiment, media transport 14 may alternatively be configured to move medium 12 in a first direction as indicated by arrow 32 during a first pass, to reverse its direction so as to move medium 12 backwards in a direction indicated by arrow 34 and to once again move medium 12 in the direction indicated by arrow 32 for an additional pass relative to print units 16, 18." and insert -- The present application claims priority under 35 U.S.C Section 120 from U.S. Patent Application Serial No. 10/830,833 filed on April 23, 2004 by Morgan Jones, Camas Osborne, Jason R. Arbeiter and Ronald A. Askeland, and entitled SYSTEM AND METHOD FOR LEVELING PRINTHEAD CARRIAGE USE, the full disclosure of which is hereby incorporated by reference. --, therefor.

In column 2, line 23, after "18." insert -- In one embodiment, media transport 14 is configured to longitudinally move a first medium having a first transverse dimension and a second medium having a second greater transverse dimension. --.

In column 10, line 12, in Claim 27, delete "spilling" and insert -- spitting --, therefor.

Signed and Sealed this

Twentieth Day of July, 2010

David J. Kappos

David J. Kappos
*Director of the United States Patent and Trademark Office*